US005174190A

United States Patent [19]

Ikari

[11] Patent Number: 5,174,190

[45] Date of Patent: Dec. 29, 1992

[54] MOVING SPEED REGULATOR FOR HYDRAULICALLY DRIVEN WORK IMPLEMENT

[75] Inventor: Masanori Ikari, Kawagoe, Japan

[73] Assignees: Komatsu MEC Corp.; Kabushiki Kaisha Komatsu Seisakusho, Japan

[21] Appl. No.: 465,261

[22] PCT Filed: Aug. 2, 1989

[86] PCT No.: PCT/JP89/00798

§ 371 Date: May 29, 1990

§ 102(e) Date: May 29, 1990

[87] PCT Pub. No.: WO90/01588

PCT Pub. Date: Feb. 22, 1990

[30] Foreign Application Priority Data

Aug. 2, 1988 [JP] Japan ..... 63-102072[U]
Aug. 9, 1988 [JP] Japan ..... 63-104559[U]

[51] Int. Cl.[5] ..... F15B 13/04
[52] U.S. Cl. ..... 91/461
[58] Field of Search ..... 91/304, 461

[56] References Cited

U.S. PATENT DOCUMENTS 3,630,121 12/1971 Lund et al. .
3,796,336 3/1974 Ratliff .
4,463,658 8/1984 Heiser et al. ..... 91/461
4,469,007 9/1984 Melocik .
4,729,222 3/1988 Tanaka et al. ..... 91/461

FOREIGN PATENT DOCUMENTS 0331076 9/1989 European Pat. Off. .
61-35959 3/1986 Japan .
61-60931 3/1986 Japan .
61-68161 5/1986 Japan .
61-294031 12/1986 Japan .
62-88805 4/1987 Japan .

OTHER PUBLICATIONS

Patent Abstracts of Japan, vol. 10, No. 130 (M-478) [2187], 14th May 1986; JP-A-60 256 605 (Hitachi Kenki K.K.) 18 Dec. 1985.
Patent Abstracts of Japan, vol. 10, No. 353 (M-539) [2409], 28th Nov. 1986; & JP-A-61 151 341 (Hitachi Constr. Mach. Co., Ltd) 10 Jul. 1986.

*Primary Examiner*—Edward K. Look
*Assistant Examiner*—F. Daniel Lopez
*Attorney, Agent, or Firm*—Ronald P. Kananen

[57] ABSTRACT

A moving speed regulator for a hydraulically driven work implement capable of automatically controlling the lifting speed of a boom, and regulating the maximum lifting speed thereof in particular during earth and sand scooping operation, and also having for its object to enable the lifting speed of the boom when the boom is lifted to a position near its highest position. This regulator comprises a pilot circuit (10) having a pilot pump (P); a hydraulic circuit for driving a work implement, which includes a work implement operating valve (g) adapted to be actuated by a pilot fluid pressure from a hydraulic pilot valve ($i_1$) installed in the pilot circuit; a pressure regulating valve (12) installed in said pilot circuit; and a change-over valve (11) for changing over the pressure regulating valve either to its operative condition or to its inoperative condition, and wherein the maximum discharge flow rate of the fluid through the work implement operating valve can be controlled by regulating the pressure of the fluid under pressure through the cooperative effect of the change-over valve and the pressure regulating valve.

1 Claim, 9 Drawing Sheets

PRIOR ART EMBODIMENT

PRIOR ART EMBODIMENT

PRIOR ART EMBODIMENT

MOVING SPEED REGULATOR FOR HYDRAULICALLY DRIVEN WORK IMPLEMENT

TECHNICAL FIELD OF THE INVENTION

This invention relates to a construction vehicles and industrial vehicles such as, for example, shovel loaders, doser shovels, fork-light trucks, etc., having loading-/unloading equipment, and more particularly to a moving speed regulator suitable for use in construction vehicles or industrial vehicles having a lifting device for hydraulically lifting and lowering a loading work implement, and a tilting device for hydraulically tilting the loading work implement.

TECHNICAL BACKGROUND OF THE INVENTION

As is heretofore publicly known, industrial vehicles and construction vehicles such as shovel loaders or the like are arranged so as to scoop earth and sand with a work implement such as a bucket mounted swingably through a boom on the front part of the vehicle body, actuate a tilting cylinder connected to the bucket so as to tilt the bucket towards the vehicle body, actuate a lifting cylinder connected between the boom and the vehicle body so as to lift up the bucket mounted on the leading end of the boom, and then transfer the earth and sand scooped by or taken in the bucket.

An example of prior art hydraulic circuit for use in operating a work implement and its function are shown in FIGS. 1A, 1B and 1C. In FIG. 1A showing prior art hydraulic circuit for operating a work implement, the fluid under pressure supplied by a hydraulic pump e is allowed through the action of a tilting control valve f to flow into a tilting cylinder d so as to drive the piston therein, and when the tilting control valve f assumes its neutral position, the fluid under pressure is allowed through the action of a lifting control valve g to flow into lifting cylinders b. (This is referred to hereinbelow as a tilting preferential circuit).

In this drawing, reference character $f_1$ denotes a tilted position for the tilting cylinder d, $f_2$ a neutral position therefor, and $f_3$ a dumping position therefor. Whilst, reference character $g_1$ denotes a raised position for the lifting cylinder b, $g_2$ a neutral position therefor, and $g_3$ a lowered position therefor. Reference character h denotes a boom kicking-out electrical detent for electrically actuating a boom kicking out device (not shown) adapted to automatically stop the upward movement of a bucket c (reference FIG. 1*c*) when the bucket is lifted up to a predetermined position.

The lifting control valve g and the tilting control valve f are adapted to be actuated by output pressures delivered by pilot valves $i_2$, $i_3$, $i_3$ and $i_4$, respectively. ($i_2$, $i_3$ and $i_4$ are not shown) The pilot valves $i_1$ and $i_2$ are connected through pilot circuits $j_1$ and $j_2$, respectively, to both ends of the lifting control valve g, whilst the pilot valves $i_3$ and $i_4$ are connected through pilot circuits $j_3$ and $j_4$, respectively, to both ends of the tilting control valve f. Reference character O denotes a pressure control valve for the pilot valve $i_1$, and P a pilot pump for the latter.

FIG. 1B shows an embodiment of the relationship between the manipulation of a work implement operating lever and the bucket load when earth and sand scooping operation is made by a vehicle having a tilting preferential type hydraulic circuit for operating the work implement. In this drawing, "lifting" in the periods of time of I and III means lifting of a lifting arm a (Refer to FIG. 1C), "tilting" in the periods of time of II, IV and VI means tilting of a bucket C (Refer to FIG. 1C) to the side of the vehicle body, and "dumping" in the period of time of V implies the turning of the bucket reverse to the "tilting".

As can be seen from the drawing, "lifting" and "tilting" of the bucket are repeatedly made to scoop earth and sand thereby in such a manner that the bucket loading does not exceed the maximum fluid pressure, and in case the bucket is not fully filled with earth and sand in the course of scooping, the bucket is turned back to a dumping direction so as to allow the object scooped thereby to get into the bucket. In the period V dumping operation, there has been a problem that a reduction in the vertical load Fv on the bucket causes a slip of front wheel tires ("t" in FIG. 1C).

Further, FIG. 1C is an explanatory view of a locus defined by the edge of the bucket in case the scooping operation described above with reference to FIG. 1B is made. In FIG. 1C, the curve indicated with reference character W shows the surface of earth and sand to be scooped by the bucket, the curve indicated with reference character A shows an ideal locus defined by the edge of the bucket, and the curve indicated with reference character B shows a locus defined by the edge of the bucket when the scooping operation described above with reference to FIG. 1B (using the prior art hydraulic circuit described hereinbefore with reference to FIG. 1A) is made.

To carry out this scooping operation, the operator manipulates alternately a lifting operation lever and a tilting operation lever (both of them not shown), or alternatively, in vehicles provided with a boom kicking out device (not shown) serving as a lifting position holding device, the operator used to perform the scooping operation by operating only the tilting operation lever while the bucket is held at its lifted position.

Out of the above-mentioned two methods of operation, the former operation method is merely troublesome repetition of the lifting and tilting operations, whilst the latter operation method has posed a significant problem that the holding position in the lifting control valve g is the maximum lifting position, and in the prior art hydraulic circuit for operating the work implement, the lifting speed of the boom when the tilting operation lever is released (in the period of time of IV in FIG. 1C) is so high that the moving speed of the bucket in the forward and upward directions cannot be controlled and sufficient amount of earth and sand cannot be scooped by the bucket, thus necessitating a useless operation such as the dumping operation to be made in the period of time of V in FIG. 1C.

SUMMARY OF THE INVENTION

The present invention has been made in view of the above-mentioned circumstances, and has for its object to provide a moving speed regulator for a hydraulically driven work implement arranged such that to enable an improved operability of a hydraulically driven work implement (that is; a bucket) during earth and sand scooping operation to be achieved the maximum lifting speed of a boom during the scooping operation can be regulated to an optimum level which is optimum for the scooping operation, and especially in case the scooping operation is made with a lifting lever engaged with a boom kicking out detent, in order to obtain a locus defined by the edge of the bucket nearly approximate to an ideal one thereby improving the operability of the bucket to sharply, the lifting speed of the boom when the tilting operation lever is returned to its neutral position can be automatically controlled.

Another object of the present invention is to provide a moving speed regulator for a hydraulically driven work implement arranged such that in order to alleviate shocks of the lifting cylinders which occur at their stroke ends, when the bucket has reached a position near its highest position with attendant increase in the pressure in the lifting cylinder bottom, which exceeds the fluid pressure for changing over a change-over valve, a pressure regulating valve can be actuated to lower the lifting speed of the boom.

A still another object of the present invention is to provide a moving speed regulator for a hydraulically driven work implement arranged such that the lifting operation of the boom during earth and sand scooping operations can be conducted by means of a switch mounted on the leading end of the bucket operation lever without the need for passing the lever from one hand to the other so that extremely easy lever operation can be achieved by using a single lever.

A still further object of the present invention is to provide a moving speed regulator for a hydraulically driven work implement wherein the pressure regulating valve and the change-over valve provided in a pilot hydraulic circuit are small-sized, and hence can be manufactured at low costs.

To achieve the above-mentioned objects, according to a first aspect of the present invention, there is provided a moving speed regulator for a hydraulically driven work implement comprising a pilot circuit having a pilot pump; a hydraulic circuit for driving a work implement, which includes a work implement operating valve adapted to be actuated by a pilot fluid pressure from a hydraulic pilot valve installed in the pilot circuit; a pressure regulating valve installed in the pilot circuit so as to regulate the fluid pressure in the pilot circuit; and a change-over valve installed in the pilot circuit so as to change over the pressure regulating valve either to its operative condition or to its inoperative condition, the arrangement being made such that the maximum discharge flow rate of the fluid through the work implement operating valve can be controlled by regulating the pressure of the fluid under pressure through the cooperative effect of the change-over valve and the pressure regulating valve.

According to a second aspect of the present invention, there is provided a moving speed regulator for a hydraulically driven work implement as set forth in the above-mentioned first aspect, characterized in that the change-over valve is changed over either to its operative condition or to its inoperative condition in response to the fluid pressure in a work implement driving hydraulic cylinder, and when the fluid pressure in the hydraulic cylinder becomes a high pressure, more than a predetermined value both the change-over valve and the pressure regulating valve, are actuated.

According to a third aspect of the present invention, there is provided a moving speed regulator for a hydraulically driven work implement as set forth in the above-mentioned first aspect, characterized in that the change-over valve is a solenoid-actuated change-over valve, and the solenoid-actuated change-over valve is adapted to be changed over either to its operative condition or to its inoperative condition by operating a switch mounted on the leading end of a work implement operating lever.

The above-mentioned and other objects, aspects and advantages of the present invention will become apparent to those skilled in the art by making reference to the following description and the accompanying drawings in which preferred embodiments incorporating the principles of the present invention are shown by way of example only.

BRIEF DESCRIPTION OF THE DRAWINGS

FIG. 1A is a circuit diagram showing one example of prior art work implement driving hydraulic circuit; FIG. 1B is a graph showing the relationship between the fluid pressure in the pilot circuit shown in FIG. 1A and the stroke of the pilot valve; and FIG. 1C is a graph showing the locus defined by the edge of a bucket during earth and sand scooping operation according to the prior art example;

FIG. 2A is a circuit diagram showing a work implement driving hydraulic circuit according to a first embodiment of the present invention; FIG. 2B is a graph showing the relationship between the fluid pressure in the pilot circuit shown in FIG. 2A and the stroke of a hydraulic pilot valve; FIG. 2C is a graph showing the flow rate of the pressurized fluid to be supplied to operate the work implement during earth and sand scooping operation; and FIG. 2D is a graph showing a locus defined by the edge of the bucket during earth and sand scooping operation.

DETAILED DESCRIPTION OF PREFERRED EMBODIMENTS

Several embodiments of the present invention will now be described below with reference to FIGS. 2A to 6.

In the first place, a first embodiment of the present invention will be described with reference to FIGS. 2A to 2D.

Figure 1A:
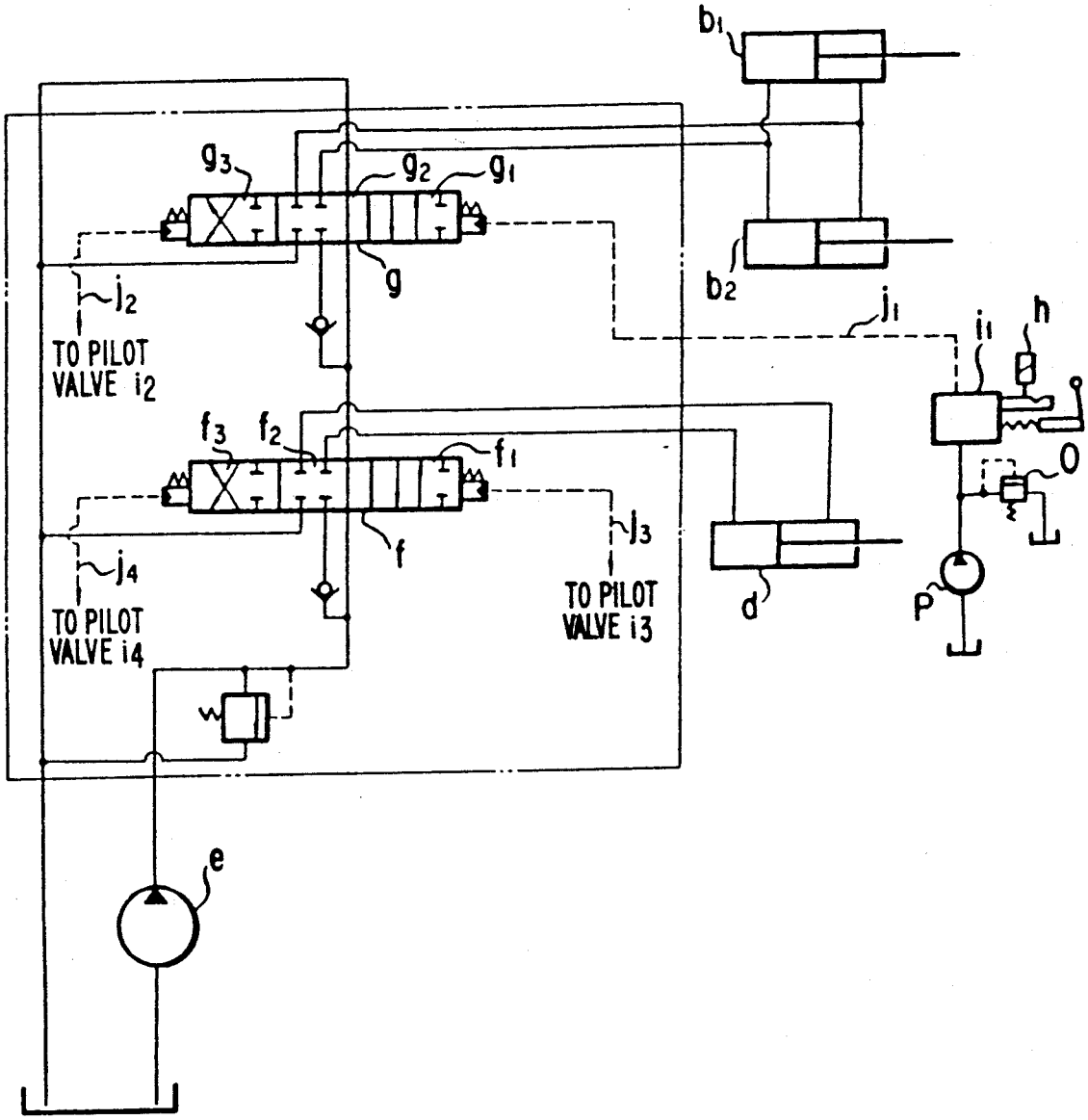
FIGS. 1A to 1C show an example of the prior art system. Stating more specifically.
Figure 1B:
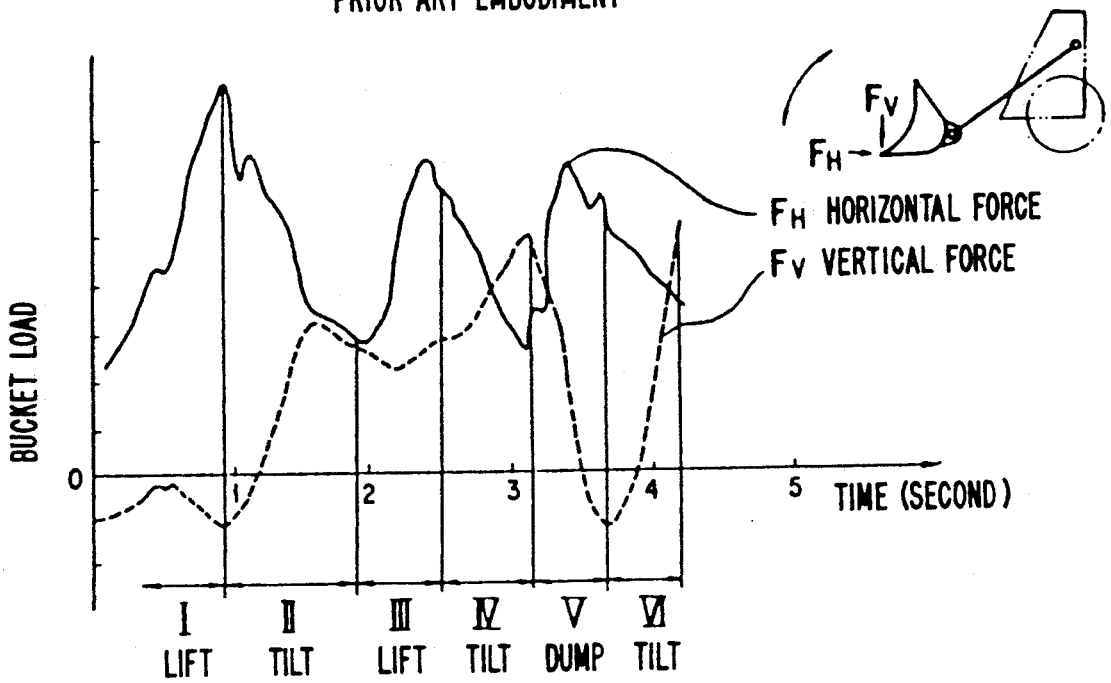
Figure 1C:
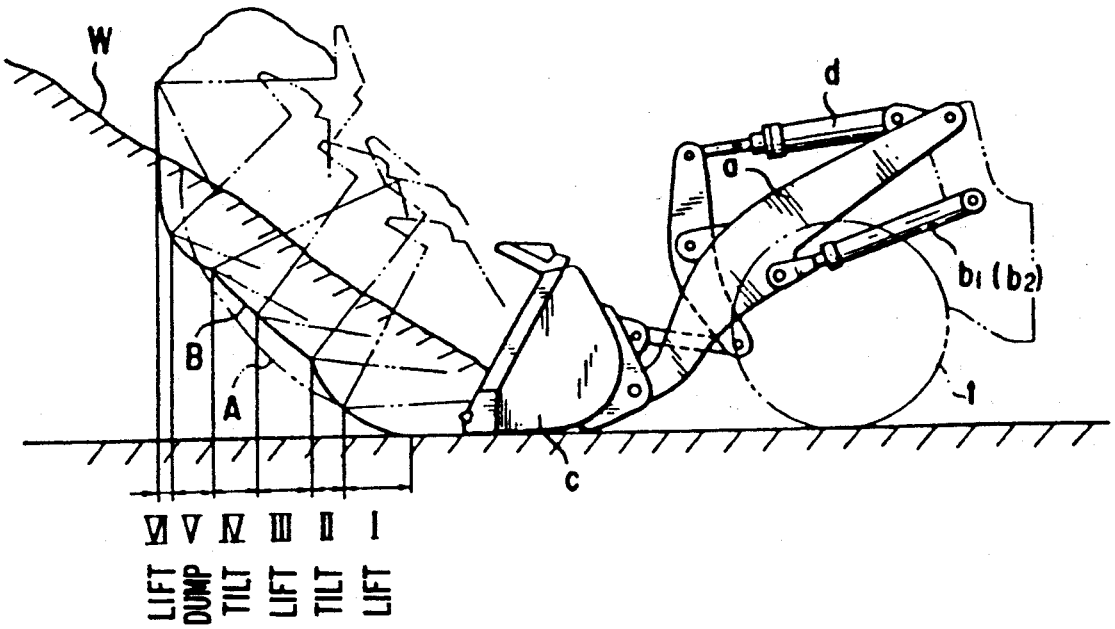
Figure 2A:
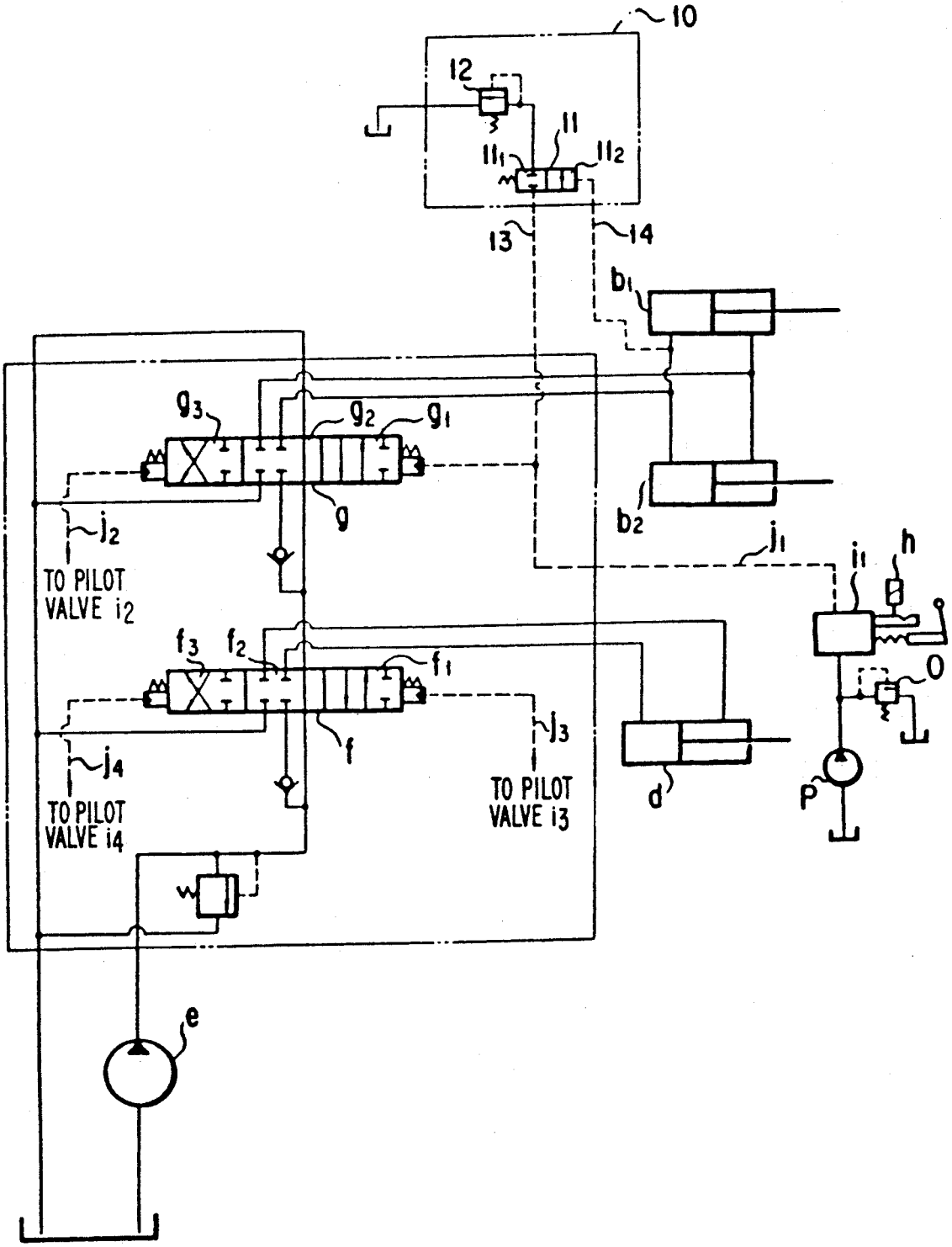
FIGS. 2A to 2D show a first embodiment of the present invention.

FIG. 2A is a circuit diagram of a work implement driving hydraulic circuit according to the present invention wherein its component parts and equipment having the same functions as those of the prior art hydraulic circuit driving hydraulic circuits described above with reference to FIG. 1A are indicated with the same reference numerals and characters, and therefore the description of them is omitted herein and a moving speed regulator 10 for a hydraulically driven work implement which differs from those of the prior art system will be described below giving priority to it.

In FIG. 2A, pilot fluid under pressure is supplied by a pilot pump P through a lifting pilot valve $i_1$ into a pilot fluid conduit $j_1$ so as to control a lifting control valve g. Further, there is provided a circuit 13 extending from this pilot fluid conduit $j_1$ through a change-over valve 11 to a pressure regulating valve 12. The fluid pressure in the bottom ends of lifting cylinders $b_1$ and $b_2$ is introduced through a pilot piping 14 into the change-over valve 11. The arrangement is made such that the change-over valve 11 is changed over to its blocked or closed position $11_1$ when the fluid pressure in the bottom ends of the lifting cylinders $b_1$ and $b_2$ (which is a pressure required to lift a boom "a" in FIG. 2D) is less than a preset pressure (which is referred to as $P_1$ below), whilst the pressure in the bottom ends of the lifting cylinders $b_1$, $b_2$ is more than the pressure $P_1$ preset for the change-over valve 11 is switched over to its open position $\mathbf{11}_2$. The setting pressure $P_2$ for the pressure regulating valve 12 is predetermined such that the flow rate of the fluid discharged by a lifting control valve g will become such a valve as to be supplied into the lifting cylinders $b_1$, $b_2$, which is suitable for the earth and sand scooping operation by means of a work implement (not shown). The arrangement is made such that even when the lifting pilot valve $i_1$ is shifted to its maximum discharge position the pilot fluid pressure in the pilot fluid conduit $j_1$ which is supplied by the pilot pump P will not increase beyond the pressure $P_2$ preset for the pressure regulating valve 12.

Figure 2B:
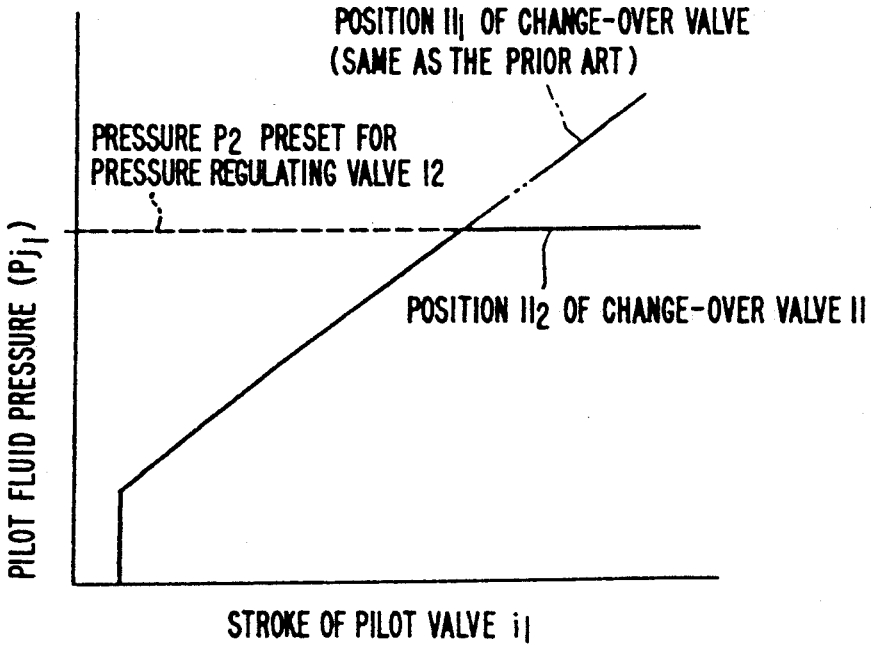

In FIG. 2B, there is shown the relationship between the pressure $P \cdot j_1$ in the pilot fluid conduit $j_1$ and the stroke of the pilot valve $i_1$.

As can be seen from the foregoing description, since in the circuit as shown in FIG. 2A the maximum lifting speed of the boom during earth and sand scooping operation is regulated to an optimum level for scooping operation, the operability of the bucket during the scooping operation is improved, and in particular in case the scooping operation is made with the lifting lever held by the above-mentioned kicking out detent h, the lifting speed of the boom can be automatically controlled when the tilting operation lever is returned to its neutral position so that the operability of the bucket can be enhanced to a large extent.

Further, since a boom "a" (refer to FIG. 2D) is lifted to a position near its highest position, the fluid pressure in the bottom ends of the lifting cylinders $b_1$ and $b_2$ will increase beyond a fluid pressure for changing over the change-over valve 11, the pressure regulating valve 12 is rendered operative in this case, too, so as to lower the lifting speed of the boom "a" so that shocks of the lifting cylinders $b_1$ and $b_2$ which occur at their stroke ends can be alleviated appreciably.

Figure 2C:
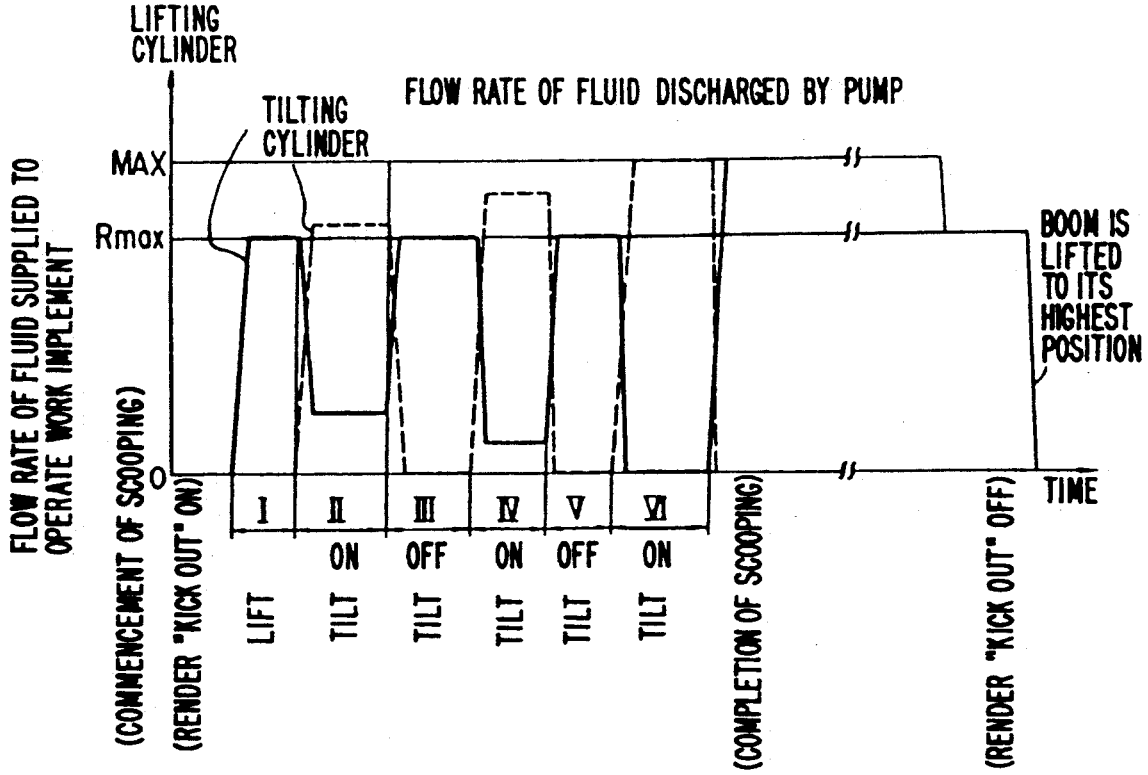

FIG. 2C is a graph showing the flow rate of fluid under pressure to be supplied to operate the work implement during an earth and sand scooping operation according to the first embodiment as shown in FIG. 2A. It can be seen from this graph that the flow rate of the fluid under pressure during the scooping operation and just before the kicking out is regulated. Further, reference character Rmax denotes a maximum flow rate of the fluid under pressure supplied to operate the work implement when the pressure regulating valve 12 is rendered operative.

Figure 2D:
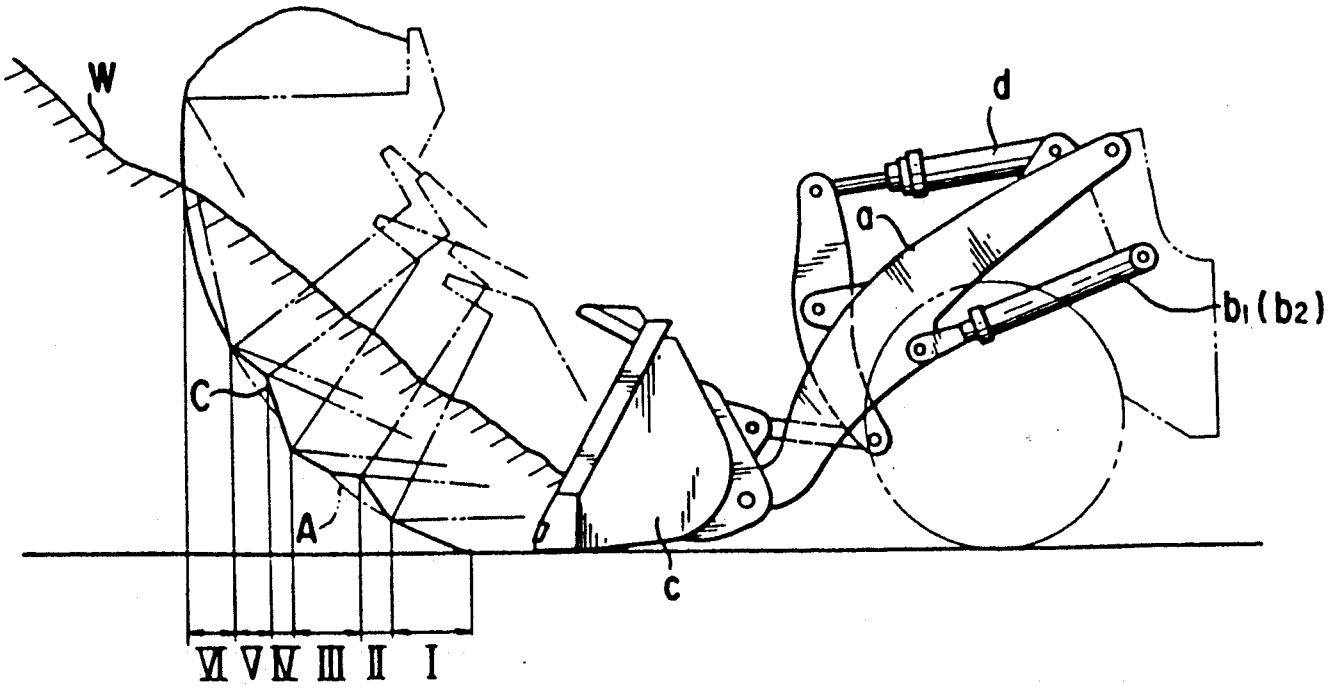

Further, FIG. 2D shows a locus C defined by the edge of the bucket when an earth and sand scooping operation is made by the embodiment as shown in FIG. 2A is made. It can be seen from this drawing that because the lifting speed of the boom is a proper value the locus C is nearly approximate to an ideal locus A to be defined by the edge of the bucket so that the operational efficiency can be much improved.

Referring again to the embodiment shown in FIG. 2A, the pressure regulating valve 12 and the change-over valve 11 are small-sized ones installed in the pilot fluid conduit $j_1$, and can control only the fluid pressure, and therefore there is no need for using expensive ones such as solenoid valves and they can be manufactured at very low costs.

Figure 3:
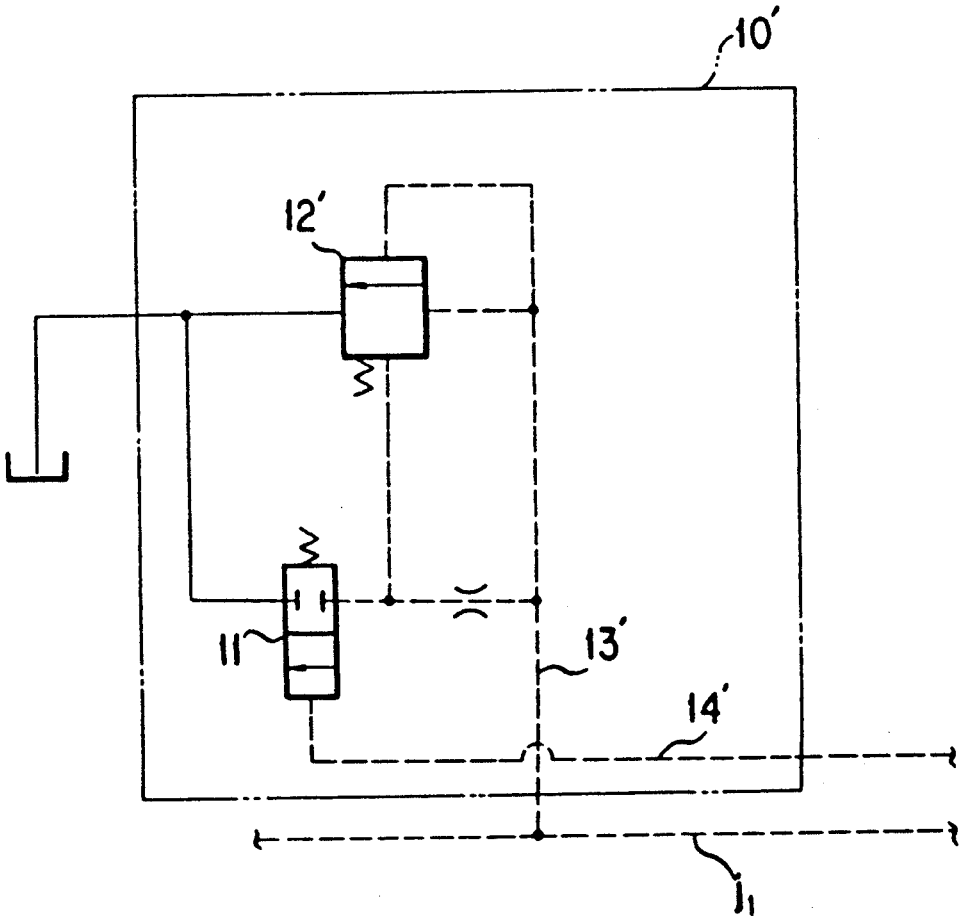
FIGS. 3 to 6 are circuit diagrams showing work implement driving hydraulic circuits according to second to sixth embodiments, respectively, of the present invention and a portion of each of the embodiments.

FIGS. 3 shows a second embodiment using a moving speed regulator 10' for a hydraulically driven work implement which fulfils the same function as that of the moving speed regulator 10 for a hydraulically driven work implement as shown in FIG. 2A. The main difference of this embodiment from that shown in FIG. 2A reside in that a pilot fluid conduit 14' for introducing the fluid pressure in the bottom ends of the lifting cylinder $b_1$ and $b_2$ and a circuit 13' extending from a pilot fluid conduit $j_1$ are provided. Reference numeral 12' denotes a pressure regulating valve.

Figure 4:
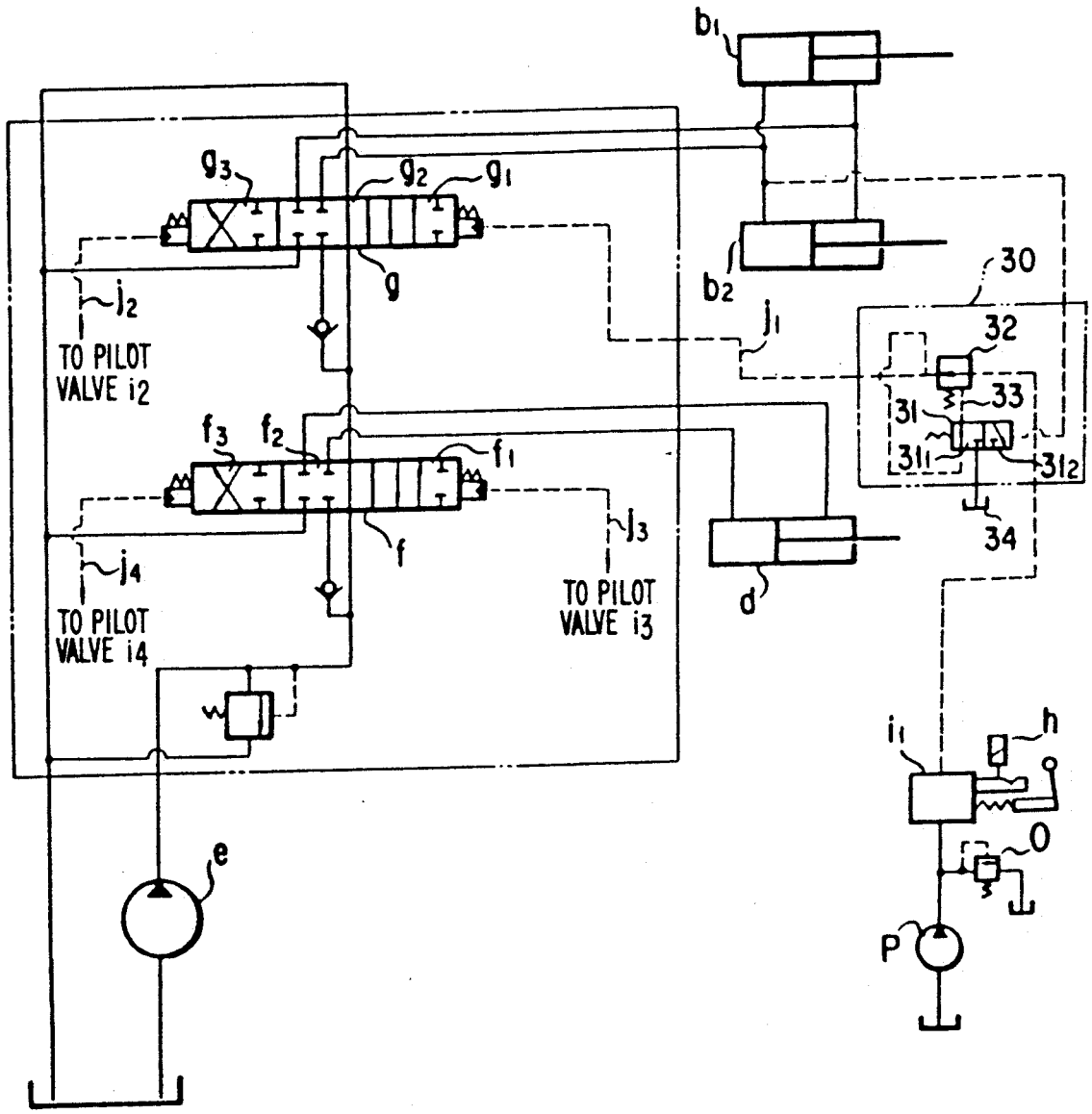

FIG. 4 shows a work implement driving hydraulic circuit according to a third embodiment of the present invention. In this drawing, the constituent elements of this embodiment which fulfil the same functions as those of the constituent elements used in the work implement driving hydraulic circuit described hereinabove with reference to FIG. 2A are indicated with the same reference numerals and characters, and therefore description of them is omitted therein. In FIG. 4, when the fluid pressure in the bottom ends of the lifting cylinders $b_1$, $b_2$ becomes high, a change-over valve 31 is changed over to its position $\mathbf{31}_2$, and a venting line 33 connected to the pressure regulating valve 32 is allowed to communicate with a fluid reservoir or tank 34 so that the pressure regulating valve 32 may regulate the pressure of the fluid from a pilot valve $i_1$ and then supplied the fluid whose pressure has been regulated into the lifting control valve g.

When the fluid pressure in the bottom ends of the lifting cylinders $b_1$, $b_2$ is low, the change-over valve 31 assumes its position $\mathbf{31}_1$ where the venting line 33 connected to the pressure regulating valve 32 is allowed to communicate with the downstream side of the pressure regulating valve 32, and as a result, the latter valve is kept open so that it may supply the pressurized fluid from the pilot valve $i_1$ into the lifting control valve g as it is, thereby conducting the ordinary operation. Stating in brief, the moving speed regulator 10 for a hydraulically driven work implement in FIG. 2A is replaced with a moving speed regulator 30 for a hydraulically driven work implement.

Figure 5:
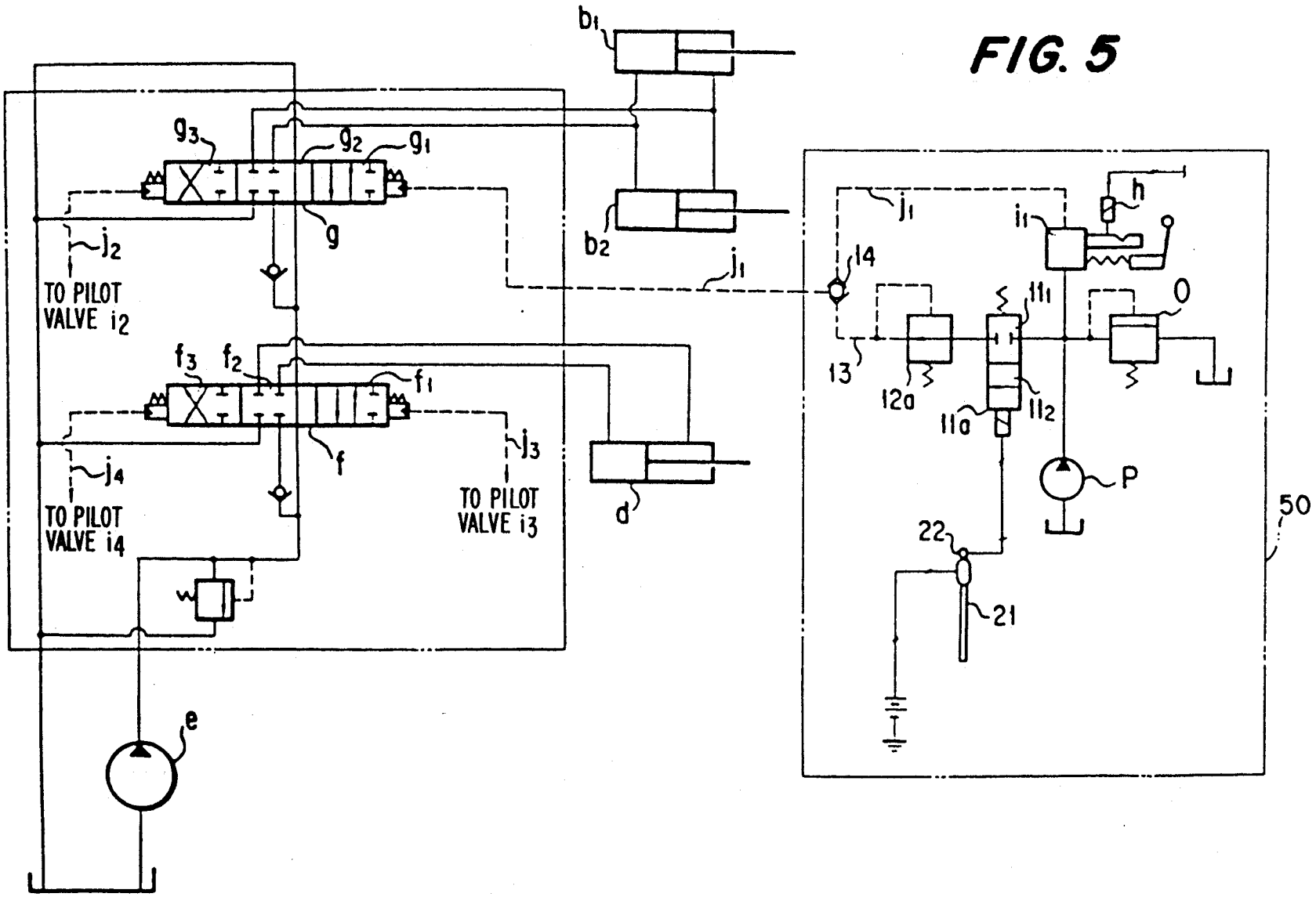

FIG. 5 shows a work implement driving hydraulic circuit according to a fifth embodiment of the present invention. In this drawing, the constituent elements of this embodiment which fulfil the same functions as those of the constituent elements used in the work implement driving hydraulic circuit described hereinbefore with reference to FIG. 2A are indicated with the same reference numerals and characters, and therefore description of them is omitted herein.

In FIG. 5, the fluid under pressure delivered by a pilot pump P is supplied by way of a pilot fluid conduit 13 into a pressure regulating valve **12*a* in parallel with a pilot fluid conduit $j_1$ connected to a lifting control valve g. As can be seen from this drawing, a solenoid-actuated change-over valve 11*a* is installed on the upstream side of the pressure regulating valve 12*a*. When a switch 22 mounted on the upper end of a bucket operating lever 21 is turned on, the solenoid-actuated change-over valve 11*a* is changed over to its open position $\mathbf{11}_2$ (reference numeral $\mathbf{11}_1$ denotes a closed position) so as to introduce the fluid under pressure delivered by the pilot pump P into the pressure regulating valve 12*a***.

The arrangement is made such that the pressurized fluid whose pressure is regulated by the pressure regulating valve 12*a* is supplied through a shuttle valve 14 into the lifting control valve g.

When earth and sand scooping operations are made by a shovel loader comprising this work implement driving hydraulic circuit, the operator can raise and lower the boom "a" (refer to FIG. 2D) by turning the switch 22 on and off while he is holding the bucket operating lever 21. At that time, since the fluid pressure delivered by the pilot pump P is regulated by the pressure regulating valve 12*a*, the flow rate of the fluid discharge by the lifting control valve g can be regulated to an optimum level for the scooping operation as in the case of the embodiment shown in FIG. 2B, so that the scooping operation can be made easily thus improving the scooping performance. Further, as in the case of the first embodiment shown in FIG. 2C, the locus C defined by the edge of the bucket during the scooping operation becomes approximate to the ideal locus A thus improving the operational efficiency.

Further, when ordinary operation of the boom lifting lever is made, the fluid pressure discharged through the lifting pilot valve $i_1$ is introduced through the shuttle valve 14 into the lifting control valve g, the boom a is lifted at its maximum lifting speed.

Figure 6:
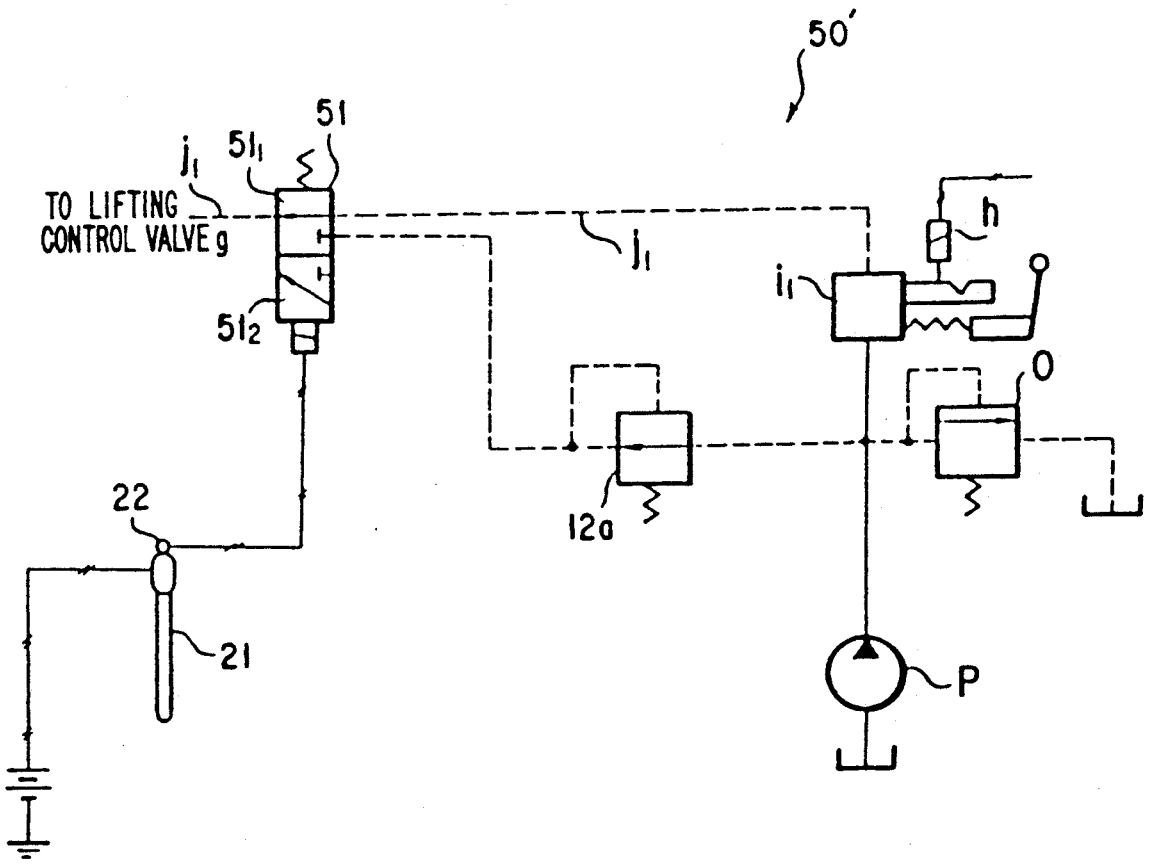

FIG. 6 is a circuit diagram of a moving speed regulator 50' for a hydraulically driven work implement according to a sixth embodiment which fulfils the same function as that of the moving speed regulator for hydraulically driven work implement as shown in FIG. 5. In this drawing, the constituent elements of this embodiment which fulfil the same functions as those of the constituent elements used in the moving speed regulator 10 for hydraulically driven work implement as shown in FIG. 2C are indicated with the same reference numerals and characters, and therefore description of them is omitted herein.

As shown in FIG. 6, a change-over valve 51 is installed on the downstream side of a pressure regulating valve 12*a*, and the arrangement is made such that when a switch 22 mounted on the uppermost end of a bucket operating lever 21 is depressed a change-over valve 51 is changed over from its closed position $\mathbf{51}_1$ to its open position $\mathbf{51}_2$ so as to supply the pressurized fluid whose pressure is regulated by the pressure regulating valve 12*a* through the pilot fluid conduit j*1* into the lifting control valve g (refer to FIG. 5).

I claim:

1. A moving speed regulator for a hydraulically driven work implement comprising a pilot circuit having a pilot pump; a hydraulic circuit for driving a work implement, which includes a work implement operating valve adapted to be actuated by a pilot fluid pressure from a hydraulic pilot valve installed in the pilot circuit; a pressure regulating valve installed in the pilot circuit so as to regulate the fluid pressure in said pilot circuit; and a change-over valve installed in said pilot circuit so as to change over the pressure regulating valve either to its operative condition or to its inoperative condition, the arrangement being made such that the maximum discharge flow rate of the fluid through the work implement operating valve can be controlled by regulating the pressure of the fluid under pressure through the cooperative effect of the change-over valve and the pressure regulating valve, characterized in that said change-over valve is changed over either to its operative condition or to its inoperative condition in response to the fluid pressure in a work implement driving hydraulic cylinder, and when the fluid pressure in the hydraulic cylinder becomes a high pressure more than a predetermined value both the change-over valve and the pressure regulating valve are actuated.

* * * * *